United States Patent [19]

Lawson

[11] Patent Number: 4,525,023

[45] Date of Patent: Jun. 25, 1985

[54] ELECTRICAL CONNECTOR

[75] Inventor: Gustaf R. Lawson, Willingboro, N.J.

[73] Assignee: AMP Incorporated, Harrisburg, Pa.

[21] Appl. No.: 531,133

[22] Filed: Sep. 12, 1983

[51] Int. Cl.[3] ..... H01R 13/12

[52] U.S. Cl. ..... 339/258 R; 339/262 R

[58] Field of Search ..... 339/258 R, 258 F, 258 P, 339/258 S, 256 SP, 262

[56] References Cited

U.S. PATENT DOCUMENTS

| | | | |
|---|---|---|---|
| 1,194,122 | 8/1916 | Ball | 339/258 R |
| 2,591,009 | 4/1952 | Richie | 339/258 S |
| 2,962,693 | 11/1960 | Ott | 339/258 S |
| 3,639,893 | 2/1972 | Kunkle et al. | 339/184 M |
| 3,706,954 | 12/1972 | Krafthefer | 339/17 L |

FOREIGN PATENT DOCUMENTS

| | | | |
|---|---|---|---|
| 684295 | 3/1965 | Italy | 339/258 R |

*Primary Examiner*—Joseph H. McGlynn

*Attorney, Agent, or Firm*—Allan B. Osborne

[57] ABSTRACT

The invention disclosed herein is an electrical connector into which a tab or blade terminal may be removably inserted. The connector includes a spring member having a resilient curved spring section and a rigid terminal having a channel section and a fastening section. The spring member is attached to the channel section with the spring section extending generally parallel to the channel floor. The tab terminal is inserted in between the spring section and floor, compressing the spring section away therefrom. The compressed spring section biases the tab terminal against the floor to establish and maintain a good electrical interface therebetween.

1 Claim, 4 Drawing Figures

18
60
74
16
10
72
70
62
14
66
46
56
38
50
52
44
54
48
58
44
40
12
36
50
34
26
50
42
32
48
24
28
30
22
20
25
24
64

ELECTRICAL CONNECTOR

BACKGROUND OF THE INVENTION

1. Field of the Invention

The present invention relates to a connector, mounted on an electrical device such as a motor, into which a tab or blade terminal may be inserted.

2. Prior Art

Prior art connectors include that disclosed in U.S. Pat. No. 4,150,863 to Krafthefer et al. The connector includes a housing into which a terminal is positioned so that a resilient, loop-shaped portion thereon and one wall of the housing defines a pin receiving receptacle. The resilient, loop-shaped portion is pre-loaded upon being inserted into the housing by reason of the size of the terminal receiving recess therein. The loop-shaped portion is further compressed when the pin is inserted so that the pin is securely held by the large force generated by the aforementioned compression.

SUMMARY OF THE INVENTION

The invention disclosed herein is an electrical connector into which a tab or blade terminal may be removably inserted. The connector includes a spring member having a resilient curved spring section and a rigid terminal having a channel section and a fastening section. The spring member is attached to the channel section with the spring section extending generally parallel to the channel floor. The tab terminal is inserted in between the spring section and floor, compressing the spring section away therefrom. The compressed spring section biases the tab terminal against the floor to establish and maintain a good electrical interface therebetween.

DESCRIPTION OF THE INVENTION

Figure 1:
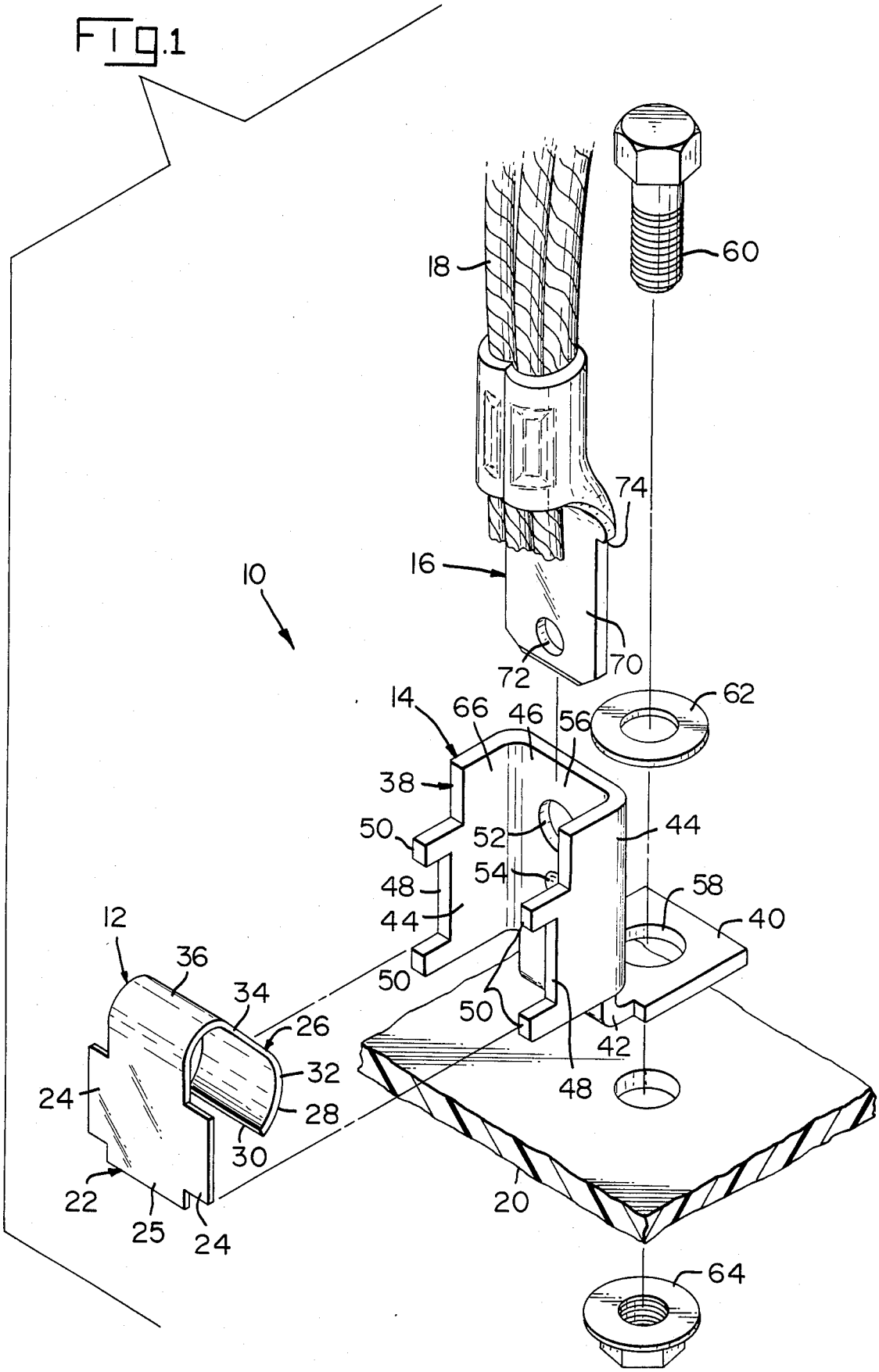
FIG. 1 is an isometric, exploded view of the electrical connector of the present invention.

The electrical connector of the present invention, indicated generally by reference numeral 10, includes spring member 12 and terminal 14, shown separately in FIG. 1. FIG. 1 also shows a tab terminal 16 with wire 18 crimped thereto. Connector 10 was initially developed to be mounted on a holder for brushes on an electric motor. The fragment 20 represents such a holder. The connector, however, has utility in many other applications.

Spring member 12 is preferably made from stainless steel with a minimum yield strength of about 111,000 PSI. The one piece spring member is formed from coplanar stock and is bent into an asymmetrical U-shape. One leg provides a flat mounting section 22 with laterally extending ears 24 and a forward projecting lip 25. The second leg provides resilient spring section 26 and is formed to have a concavo-convex portion 28 adjacent free end 30 with the convex surface 32 of portion 28 facing away from mounting section 22. End 30 curves in towards the mounting section and more particularly lip 25. The spring section further includes a straight portion 34 positioned between concavo-convex portion 28 and the bight 36 which interconnects the mounting and spring sections.

Terminal 14 includes a channel section 38, fastening section 40 and a connecting strap 42 joining the two aforementioned sections. Channel section 38 includes spaced-apart sidewalls 44 with floor 46 extending between and connecting the sidewalls. Notch 48, defined by posts 50, are provided on the free, longitudinal edge of each sidewall. The width of each notch is such as to conformably receive an ear 24 on spring member 12. Hole 52 and boss 54 are provided in and on the floor wall respectively with the boss being on inner surface 56 of the channel floor.

Fastening section 40 is a flat plate with hole 58 extending therethrough. For the application alluded to above, the section extends at a right angle relative to channel section 38. Mounting bolt 60 projects, through hole 58 to secure the terminal to fragment 20. Other fastening means which also provides a conduit for the electrical current following from tab terminal 16 through channel section 38 and into the electrical device connector 10 may be substituted.

Terminal 14 is preferably stamped and formed from an electrolytic tough pitch copper which has been one quarter hardened. The copper is preferably plated; e.g., with a ten thousandth inch thick plating of silver.

FIG. 1 also shows washer 62 and nut 64 used in conjunction with bolt 60.

Figure 2:
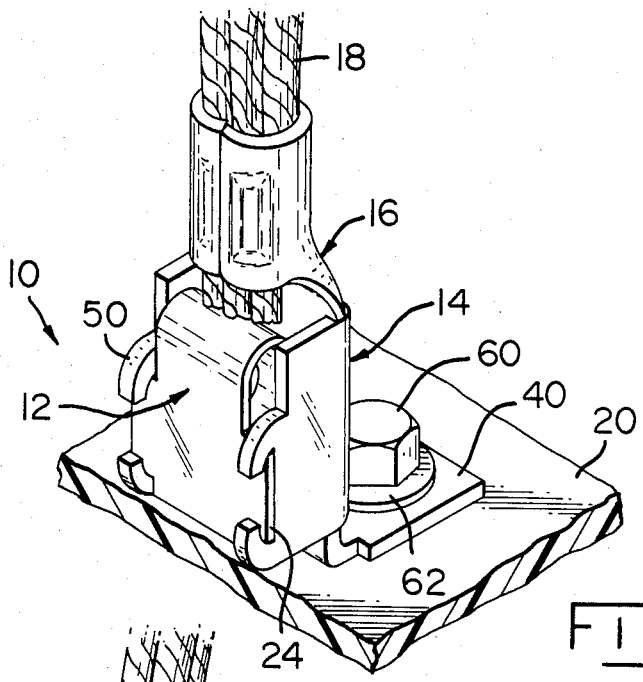
FIG. 2 shows the connector of FIG. 1 assembled and with a tab terminal inserted therein.

Connector 10 is formed by attaching spring member 12 to terminal 14. This is done by placing the spring member into channel section 38 with ears 24 in notches 48 and spring section 26 into the channel space defined by the sidewalls 44 and floor 46 and indicated by reference numeral 66. A tab receptacle is defined by the spring section and floor. Posts 50 are peened over ears 24 to secure the spring member in the channel section. FIG. 2 shows an assembled connector 10 with tab terminal 16 inserted thereinto. The drawing also shows the connector mounted to motor fragment 20 using bolt 60 and nut 64.

Figure 3:
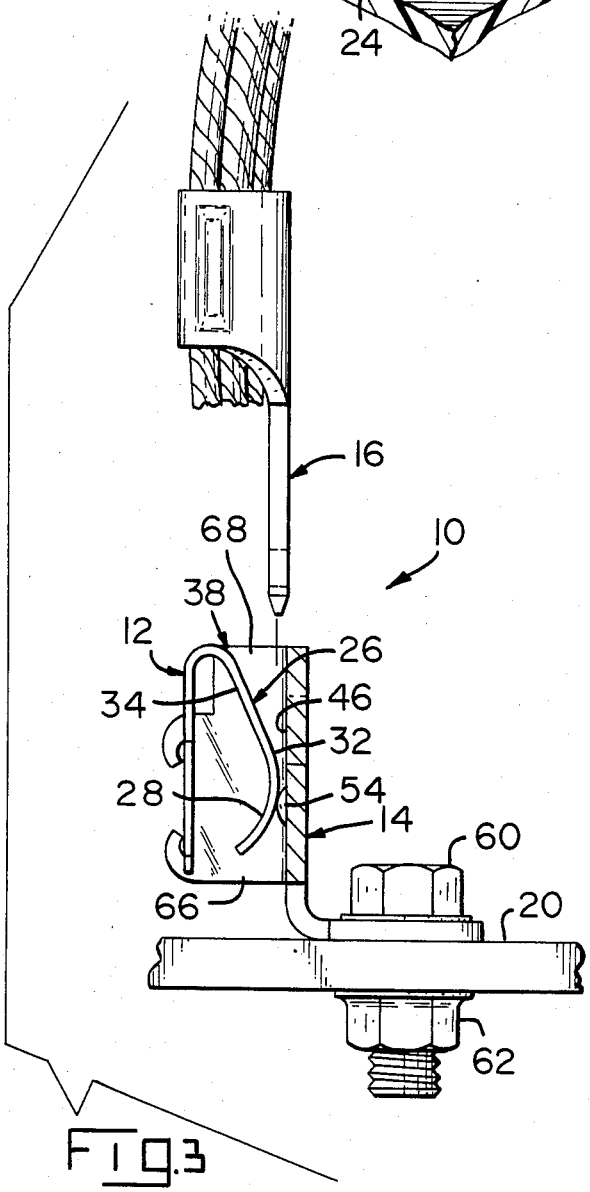
FIG. 3 is a view showing the connector partially sectioned.

FIG. 3 is a cross-sectional view of connector 10. The drawing shows the spring section in channel 66 and bearing against boss 54. The concavo-convex portion is generally parallel to floor 46. Also illustrated is an asymmetrical funnel entrance 68 defined by straight portion 34, positioned at an angle to channel floor 46 and the channel floor. In the absence of boss 54, the concavo-convex portion preferably would bear against the floor itself.

Figure 4:
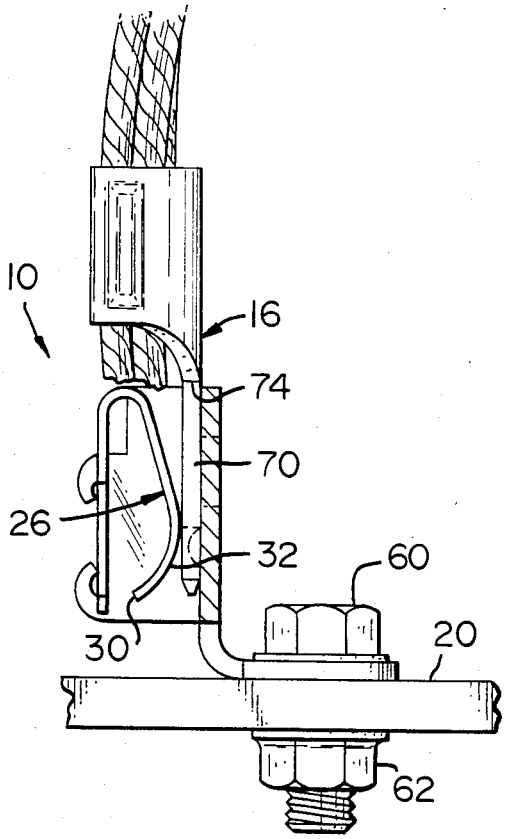
FIG. 4 is a FIG. 3 view showing a tab terminal inserted in the connector.

FIG. 4 is a cross-sectional view similar to FIG. 3 but with tab terminal 16 inserted into connector 10. Tab 70 of terminal 16, positioned in the receptacle defined by the channel floor and spring section 26, is removably locked thereinto by boss 54 entering hole 72 (FIG. 1) in the tab. The spring section biases the tab against the floor for electrical contact and retention. Ears 74 on tab 70 abut the rearwardly facing edges of sidewalls 44 at the point where the boss enters hole 72. Thus the tab cannot pass beyond that point.

The ease of manufacturing the components and assembly thereof to form connector 10 represents one of the novel features of the present invention. The funnel-like entrance, indicated in FIG. 3 by reference numeral 68, is also a significant improvement in these type connectors as is the shape of the spring member overall.

The straight portion provides a longer spring arm for improved resiliency.

As sometimes happens, wire 18 will be moved and that motion may be transmitted to tab terminal 16 attached thereto. Sideways or lateral motion of wire 18 would not move tab 70 because of being confined by the channel sidewalls. However, up and downward travel would cause the tab to move against spring section 26. This motion will compress the section towards the mounting section 22, but free end 30 will bear against lip 25 and prevent over stressing and damage to the spring section.

The foregoing detailed description has been given for clearness of understanding only, and no unnecessary limitations should be understood therefrom, as some modifications will be obvious to those skilled in the art.

I claim:

1. An electrical connector for use with tab terminals and the like comprising:

a. an asymmetrical, U-shaped spring member with a first leg providing a spring section and a second leg having laterally projecting ears; and b. a terminal having a fastening section for fastening the terminal to an electrical device; a channel section for receiving the spring member with the spring section thereon being generally parallel to a floor of the channel section and providing therebetween a tab terminal receptacle, and posts on the sidewalls peened over the ears on the second leg to secure the spring member to the terminal.

* * * * *